US007716499B2

(12) United States Patent
Kobayashi

(10) Patent No.: US 7,716,499 B2
(45) Date of Patent: May 11, 2010

(54) ELECTRONIC APPARATUS SUPPLYING POWER TO EXTERNAL EQUIPMENT BASED ON INFORMATION RECEIVED FROM A HOST OR THE EXTERNAL EQUIPMENT

(75) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 664 days.

(21) Appl. No.: 11/463,635

(22) Filed: Aug. 10, 2006

(65) Prior Publication Data

US 2007/0049058 A1 Mar. 1, 2007

(30) Foreign Application Priority Data

Aug. 31, 2005 (JP) ..... 2005-251138

(51) Int. Cl.
*G06F 1/00* (2006.01)
*G06F 1/32* (2006.01)

(52) U.S. Cl. ..... 713/300; 713/310; 713/320

(58) Field of Classification Search ..... 713/300
See application file for complete search history.

(56) References Cited

U.S. PATENT DOCUMENTS 6,147,682 A * 11/2000 Kim ..... 345/211
6,256,516 B1 * 7/2001 Wagner et al. ..... 455/565
6,516,418 B1 * 2/2003 Lee ..... 713/320
7,203,044 B2 * 4/2007 Ando et al. ..... 361/79
7,424,625 B2 * 9/2008 Kawanabe ..... 713/300
2002/0149789 A1 * 10/2002 Okazawa ..... 358/1.14
2003/0070103 A1 * 4/2003 Kim ..... 713/300

FOREIGN PATENT DOCUMENTS

JP 2004-284173 A 10/2004

* cited by examiner

*Primary Examiner*—Suresh K Suryawanshi
(74) *Attorney, Agent, or Firm*—Panitch Schwarze Belisario & Nadel LLP

(57) ABSTRACT

An electronic apparatus, capable of efficiently supplying power in accordance with execution process analysis of the electronic apparatus and classification of externally connected external equipment, includes an equipment connection section for connecting with multiple external equipments, a process judgment section for making a judgment as to a process to be performed by the electronic apparatus, an equipment selection section for selecting external equipment based on the judgment result of the process judgment section, and a power supply section for supplying power to the external equipment selected by the equipment selection section.

12 Claims, 12 Drawing Sheets

FIG. 11

USB DEVICE1
NAME:xxxxxxxxxx
TYPE:MEMORY
POWER:3000
MAKER:xxxxxxxx
CONTENTS:KANJI FONT A USB DEVICE2
NAME:yyyyyyyyy
TYPE:FINGER PRINT
POWER:5000
MAKER:yyyyyyyy
CONTENTS:–

FIG. 12

USB DEVICE1
NAME:xxxxxxxxxx
TYPE:MEMORY
POWER:3000
MAKER:xxxxxxxx
CONTENTS:KANJI FONT A

USB DEVICE2
NONE

FIG. 17

| | EXTERNAL EQUIPMENT | NUMBER OF TIMES | JOB |
|---|---|---|---|
| 1 | FINGERPRINT | 1 | 1 |
| 2 | MEMORY | 5 | |
| 3 | FINGERPRINT | 1 | 2 |
| 4 | MEMORY | 6 | |
| 5 | MEMORY | 2 | 3 |
| ⋮ | ⋮ | ⋮ | ⋮ |

ELECTRONIC APPARATUS SUPPLYING POWER TO EXTERNAL EQUIPMENT BASED ON INFORMATION RECEIVED FROM A HOST OR THE EXTERNAL EQUIPMENT

BACKGROUND OF THE INVENTION

The present invention relates to an electronic apparatus having an interface section capable of supplying power to and transmitting information with external equipment connected externally.

Conventionally, in electronic apparatuses capable of connecting externally to a plurality of external equipments, there are multiple interface sections capable of supplying power to and transmitting information with external equipment connected externally via cables such as USB cables. It is possible for each of these external equipments connected externally to supply an established amount of power such as 2.5 W. In a case where it is necessary during the execution of the performance of the electronic apparatus, the external equipments are made to perform and the performance demanded via such a local network as a LAN from a computer such as the host PC is executed in accordance with the operation of the user. In a recording apparatus capable of recording image information stored in external equipment and having, for example, a USB interface and a memory card interface as the interface connectable to the external equipment, the connected conditions of the external equipments connected to these USB and memory card interfaces are detected. When it is detected that the external equipments are connected to both of these two types of interfaces, a judgment is made as to whether the total electrical energy demanded by these external equipments exceeds the maximum value of electrical energy to be supplied to the external equipments by the recording apparatus. If the total energy exceeds the maximum value, the external equipments are selected in accordance with the performance condition of the previously connected external equipments, and power is then supplied (see generally, Japanese Application Publication JA2004-284173 (pgs. 1-12, FIG. 4)).

In the aforementioned conventional electronic apparatus, however, in a case where a plurality of external equipments is connected by an interface section, it is necessary to ensure a large amount of power in order to supply the required power for each of the multiple external equipments. For example, in order to supply 2.5 W of power for each of four external equipments, it is necessary to ensure 10 W of power. For this reason, the total amount of energy supplied is greatly increased when many external equipments are connected and, in a case where power necessary for the performance of the electronic apparatus itself is a small amount rather than a large amount, the electronic apparatus is made larger and the cost is greatly increased with the goal of ensuring a greater power supply.

Also, in the recording apparatus according to the aforementioned Japanese Patent Application to prevent this type of increase in the supply of power, external equipments are selected in accordance with the performance condition of the previously connected external equipments, and power is then supplied, but, in this recording apparatus, regardless of desire to use the externally connected external equipments there are instances where power is not supplied to the appropriate external equipment to render the equipment useless.

The present invention is made in consideration of these problems, it is an objective to provide an electronic apparatus capable of efficiently selecting and supplying power to external equipments in accordance with the analyzed process performance of the electronic apparatus and the type of externally connected external equipments.

BRIEF SUMMARY OF THE INVENTION

In order to achieve the aforementioned goal, electronic apparatus of the present invention has an equipment connection section connectable to multiple external equipments, a process judgment section for judging a process performed by the apparatus, an equipment selection section for selecting the external equipment requiring a supply of power, and a power supply section for supplying power to the external equipment selected by the equipment selection section.

With the electronic apparatus, because the process judgment section analyzes the received data and makes a judgment the process to be performed and because the equipment selection section selects the external equipment necessary for the process to be performed, the electronic apparatus can efficiently supply power to the external equipment.

The received data can be printing data sent from host apparatuses. This received data may also be a performance instruction command input from the operation panel. The electronic apparatus may receive information from the user and host apparatuses.

The electronic apparatus may further have a classification information retrieval section for retrieving classification information concerning the classification of the equipment from the external equipment connected to the equipment connection section, and the equipment selection section selects the external equipment requiring a supply of power based on the classification information retrieved by the classification information retrieval section and the judgment result of the aforementioned process judgment unit, so that the appropriate equipment for the performance is selected and that power is supplied to the appropriate external equipment according to the classification information.

The electronic apparatus may further have a connection detection section for detecting whether the external equipment is connected to or removed from the equipment connection section. Power is therefore sufficiently supplied to the equipment based on the connection condition of the external equipment.

From another aspect of the invention, the electronic apparatus includes an interface section capable of supplying power and transmitting information to external equipment connected externally, a connection detection section for detecting whether the external equipment is connected to or removed from the interface section, a classification information retrieval section for retrieving classification information concerning classification of the external equipment from the external equipment connected to the interface section, a process analysis section for analyzing a process performed by the electronic apparatus, and a power supply section for selecting external equipment requiring a supply of power and supplying power to this external equipment based on the classification information retrieved by the classification information retrieval section and analysis results of the process analysis section.

In this invention, because the process analysis unit analyzes the process performed by the electronic apparatus and because the power supply section selects the external equipment requiring a supply of power and supplies power to this external equipment based on the classification information retrieved by the classification information retrieval section and the analysis results of the process analysis section, the electronic apparatus can supply power during the operation of the external equipment according to the performance conditions of the external equipment upon analyzing the process executed.

In the electronic apparatus, the connection detection unit may detect whether the external equipment is connected to or removed from the interface section in a condition where power is not supplied to the external equipment.

The electronic apparatus may further have an information reading section for reading parameter information including address information of the external equipment at a time where the power supply section stops the supply of power to the external equipment and an information setting section for inputting the parameter information read by the information reading section into the external equipment at a time where the power supply section resumes the supply of power to the external equipment.

Through this type of construction, the information reading section reads the parameter information that previously includes the address information of the external equipment at a time where the power supply section stops the supply of power to the external equipment. At a time where the power supply unit resumes the supply of power to the external equipment, the process of the electronic apparatus can be efficiently performed even where the user does not execute setting input and the like using a manual, backup data, and the like because the information setting section automatically inputs the parameter information into the external equipment.

In addition, the electronic apparatus further has a performance judgment section for making a judgment as to whether performance of the external equipment connected to the interface section in the process performed by the electronic apparatus is necessary based on the classification information and analysis results of the process analysis section.

Through this type of construction, it is possible to select the appropriate external equipment requiring a supply of power and to supply power to the external equipment in question because the performance judgment unit makes a judgment based on the analysis results of the process analysis unit and the classification information as to whether performance of the external equipment connected to the interface section in the process performed by the electronic apparatus is necessary.

Further, in the electronic apparatus, the process analysis section detects a keyword showing the performance executed by the external equipment and included in the process data based on the process performed by the electronic apparatus, the performance judgment section makes a judgment as to whether performance of the external equipment connected to the interface section is necessary based on the classification information and the keyword detected by the process analysis section, and the power supply section, in a case where the performance judgment section makes a judgment that performance of the external equipment is necessary, supplies power to the external equipment and can stop the supply of power after the process is finished. Through this type of construction, it is possible to make an appropriate judgment as to whether performance of the external equipment is necessary because the performance judgment section makes a judgment as to whether performance of the external equipment connected to the interface unit is necessary based on the keyword detected by the process analysis section and the classification information. In a case where the performance judgment section makes a judgment that performance of the external equipment is necessary, the power supply section supplies power to the external equipment and, in accordance with the performance condition of the externally connected external equipment, is capable of efficiently supplying power because the supply of power is stopped after completion of this performance.

In the electronic apparatus, the process analysis section may analyze the process performed by the electronic apparatus based on the printing data sent via the network. Through this type of construction, it is possible to efficiently supply power to the external equipment in accordance with the external equipment made necessary by the execution of a process by the electronic apparatus at the process of printing and the like performed by the electronic apparatus based on the printing data.

In the above manner, the electronic apparatus of the present invention has the effect of being able to efficiently select and supply power to external equipments in accordance with the analysis process performance of the electronic apparatus and the type of externally connected external equipments.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 11 is an explanatory diagram showing the display row of the operation panel display unit of the first embodiment;

FIG. 12 is an explanatory diagram showing another display row of the operation panel display unit of the first embodiment;

FIG. 17 is a list showing the external equipment and number of performances of the external equipment tasks through the printing process job performed with each printing data.

DETAILED DESCRIPTION OF THE INVENTION

First Embodiment

Figure 1:
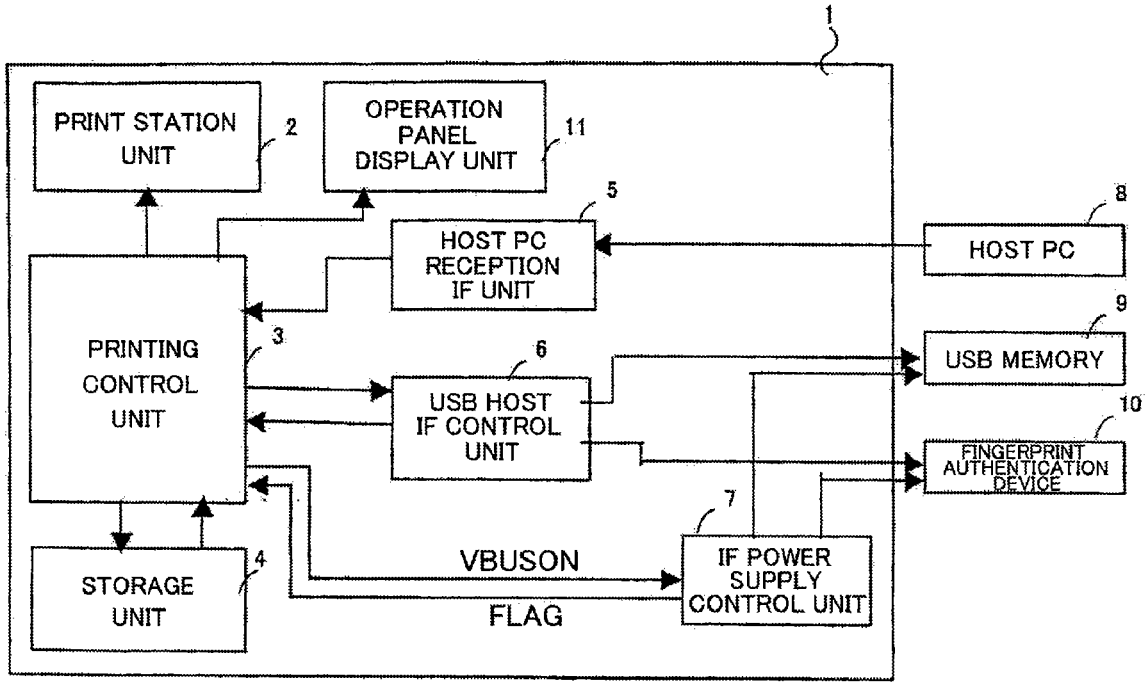
FIG. 1 is an explanatory diagram showing the construction of the entire electronic apparatus of the first embodiment.

The following is a detailed explanation using diagrams concerning the best mode for carrying out the first embodiment of the present invention. FIG. 1 is an explanatory diagram showing the construction of a printing apparatus 1 that is a specific example of the electronic apparatus of the present invention. The printing apparatus 1 of the present invention has a print station unit 2 having a station capable of rasterizing printing data and executing actual printing based on created pixel data, a printing control unit 3 that executes the rasterization process or the like for the printing data sent from a host PC 8 set up externally, a storage unit 4 that stores a program concerning the process executed by the printing control unit 3, a host PC reception IF unit 5 capable of transmitting information with the host PC 8 connected via a cable or the like, a USB host IF control unit 6 capable of transmitting information with a fingerprint authentication device 10 and a USB memory 9 that are external equipments connected via a cable such as a USB cable, an IF power source control unit 7 capable of supplying power to the external equipments such as the USB memory 9 and fingerprint authentication equipment 10 and detecting whether an external unit has been connected to or detached from the USB host IF control unit 6, and an operation panel display unit 11 equipped with a switch for executing the operation of the printing apparatus 1 and displaying to the user the connection condition of the external equipments and performance condition of the printing apparatus 1.

Figure 2:
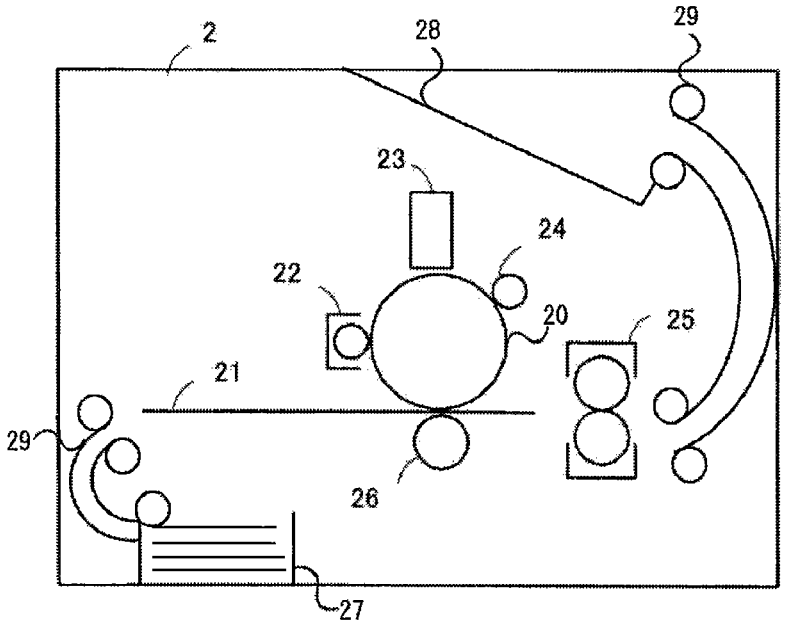
FIG. 2 is an explanatory diagram showing the construction of the print station unit of the electronic apparatus of the first embodiment.

FIG. 2 is an explanatory diagram showing the construction of the print station unit 2. The print station unit 2 has a developing machine 22 for affixing toner to and developing a static latent image on the surface of a photoconductive drum 20 that displays an image for printing on a printing medium 21 such as recycled paper or glossy paper, an exposure device 23 implemented in an LED array made of multiple LEDs and a laser scanner that scans the static latent image with such as a mirror circling a single light source formed on the surface of the photoconductive drum 20, a charging device 24 that uniformly charges the photoconductive drum 20, a fusing device 25 for fusing images transferred to the printing medium 21 by heat and pressure using a roller, a transfer device 26 for transferring the images developed on the surface of the photoconductive drum 20 to the printing medium 21 using a roller, a tray 27 that stores the printing medium 21, and a delivery tray 28 for storing the delivered printing medium 21 on which images are printed by way of the medium transportation path 29. In addition, printing using the electrophotography method is realized by this type of construction but it is also acceptable to have any other methods such as inkjet if printing of the images on the surface of the printing medium 21 with ink and toner is possible by impact force and spraying of ink.

The printing control unit 3, along with being used as a process judgment section for judging a process performed by the apparatus, is used to as an equipment selection section for selecting external equipments requiring a supply of power. The printing control unit 3 is capable of executing various processes through performance of the program stored in the storage unit 4. For example, the printing control unit 3 is capable of executing the process to rasterize the printing data sent received from the host PC 8 by the host PC reception IF unit 5 and create the pixel data.

The storage unit 4 contains a ROM storing the programs performed by the printing control unit 3 and a RAM storing information, data, and the like necessary for occasions where the printing control unit 3 executes a process. The host PC reception IF unit 5 is, for example, a USB interface, a Centronics interface, and the like capable of transmitting information with a host PC 8 connected via a cable and the like.

Figure 9:
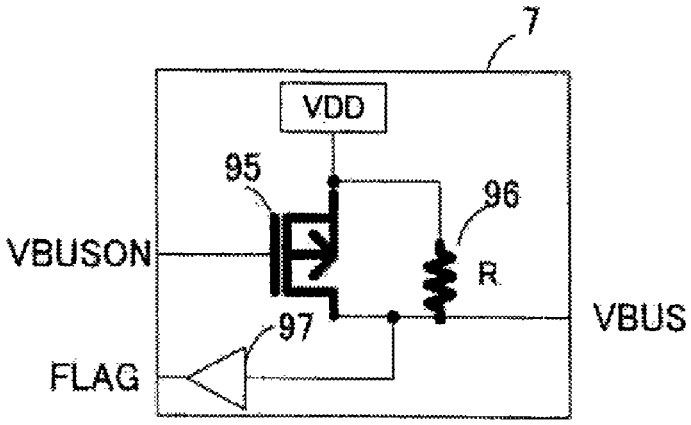
FIG. 9 is an explanatory diagram showing the construction of the IF power source control unit of the first embodiment.

FIG. 9 is an explanatory diagram showing the structure of the IF power source control unit 7. The IF power source control unit 7, as shown in FIG. 9, is made from an FET switch 95 capable of controlling the ON/OFF condition through the control signal VBUSON sent from the printing control unit 3, a resistor R96 linking the FET switch 95 and the line VBUS that is the power source line supplying power to the external equipment, and a comparator 97 connected to the FET switch 95. In addition, the IF power source control unit 7 also contains a number of circuits shown in FIG. 9 corresponding to the number of connectable interfaces. In a case where external equipment is connected to the line VBUS when the FET switch 95 is OFF, a small amount of current, via the resistor R96, passes through the line VBUS and flows into the external equipment. The comparator 97 senses this current and converts it into the signal FLAG, which is transmitted to the printing control unit 3, and the printing control unit 3 detects that external equipment is connected externally to the printing apparatus 1. In a case where external equipment is not connected to the line VBUS, a small amount of current does not pass through the line VBUS and flow into the external equipment. Accordingly, detection is possible even where the external equipment is cut off or removed.

The USB memory 9 is made from a USB device IC that performs transmissions of information via a USB cable and a NAND flash memory storing information and data. The USB memory 9 stores font data and the like for displaying characters such as letters of the alphabet and kanji previously included in the images to be printed. The fingerprint authentication device 10 extracts the fingerprint data of the fingerprint of the user through an authentication panel on which the finger of the user is pressed. The fingerprint authentication device 10 has a USB device IC that performs transmission of information via a USB cable and a fingerprint authentication sensor that identifies the user and executes certification based on the fingerprint data. The fingerprint authentication device 10 operates with the power supplied from the IF power source control unit 7 of the printing apparatus 1.

Figure 6:
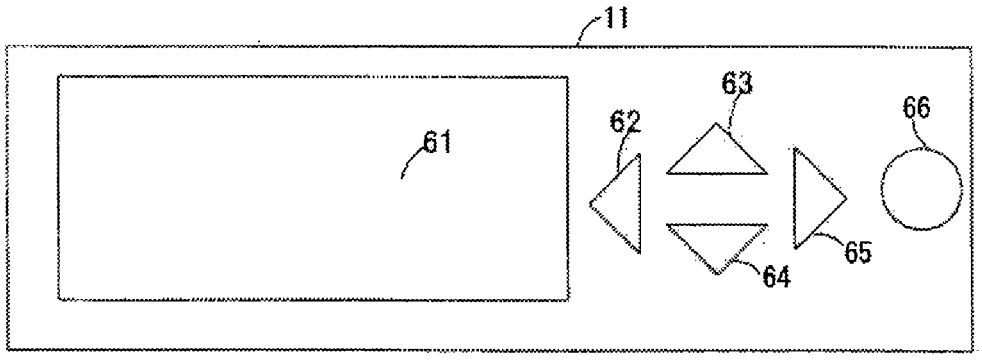
FIG. 6 is an explanatory diagram showing the construction of the operation panel display unit of the first embodiment.

FIG. 6 is an explanatory diagram showing the construction of the operation panel display unit 11. The operation panel display unit 11 is equipped with an LCD 61 for displaying and transmitting information sent from the printing control unit 3 and buttons 62, 63, 64, 65, and 66 for execution by the user of a determination operation and selection operation concerning the printing settings in accordance with the contents of the information displayed by the LCD 61. Also, when the user executes the determination operation and selection operation concerning the printing settings using the buttons 62, 63, 64, 65, and 66, there is a function for the information of the selected selection information and the like to the printing control unit 3 as a performance instruction command.

Figure 3:
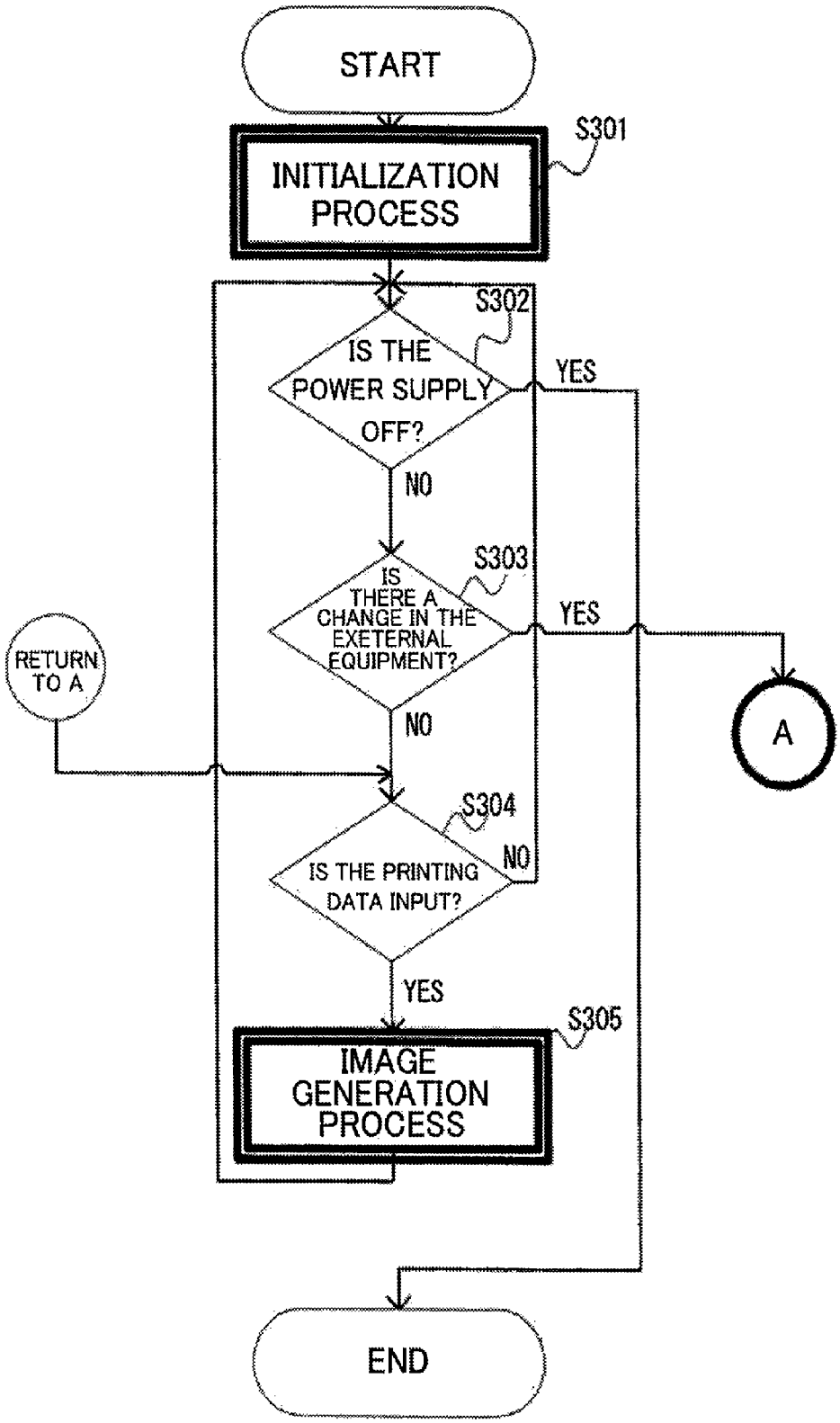
FIG. 3 is a flow chart showing the performance of the entire electronic apparatus of the first embodiment.

Concerning the performance of the printing apparatus 1 of the first embodiment, a detailed explanation is given using diagrams. First, concerning the entire performance of the printing apparatus 1 from when a power source, not shown, is input and the power is turned on to when the power is turned off, an explanation is given using the flow chart shown in FIG. 3. When the power, not shown, is turned on by the user, the printing apparatus 1 begins an initialization process for the entire apparatus (step S301). The printing control unit 3 and storage unit 4 are then initialized. Concerning the performance of each of these initializations, a detailed explanation is given later.

Next, the printing apparatus 1 makes a judgment as to whether the power is turned off (step S302). In a case where the power is turned off ("YES" of step S302), the performance of the entire printing apparatus 1 is finished.

Next, in a case where the power is not turned off ("NO" of step S302), the printing control unit 3 executes the process to detect whether the external equipment is connected or removed from the USB host IF control unit 6 and whether a change has arisen in the connection condition (step S303). In a case where a change has arisen in the connection condition ("YES" of step S303), the process is executed to retrieve classification information from the external equipment.

Next, in a case where a change has not arisen in the connection condition ("NO" of step S303), a judgment is made as to whether the selection information, printing data, and the like have been sent according to the determination operation and selection operation concerning printing settings from the operation panel display unit 22 (step S304). In a case where the information of the selection information and the like has not been sent ("NO" of step S304), the printing control unit 3 executes the image generation process that executes printing of the images based on the printing data (step S305).

Figure 4:
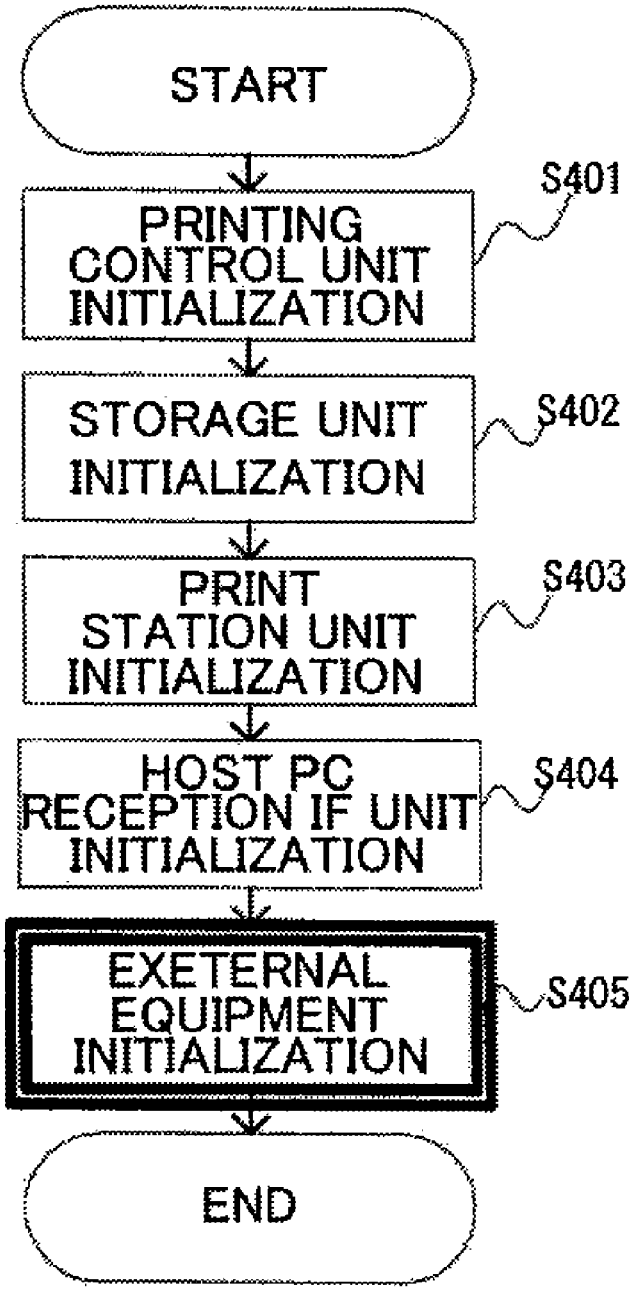
FIG. 4 is a flow chart showing the initialization process of the entire electronic apparatus of the first embodiment.

Concerning the initialization process of the entire printing apparatus 1 in the aforementioned step S301, a detailed explanation is given based on FIG. 4. When the initialization process of the entire printing apparatus 1 is initiated, the printing control unit 3 is initialized (step S401). Specifically, initialization is executed in a manner such that the CPU, ASIC, and the like that realize the performance of the printing control unit 3 are capable of initiating various types of performances.

Next, the printing apparatus 1 initializes the storage unit 4 (step S402). Specifically, initialization is executed in a manner such that reading from the ROM and reading or writing of information for the RAM is possible. Through this type of initialization, the printing control unit 3 can read and execute a program from the ROM and begin various types of performances.

Next, the printing apparatus 1 initializes the print station unit 2 (step S403). Specifically, in order to make it possible to fuse the images with the fusing device 25 contained in the print station unit 2, a cleaning performance is executed to remove dust, trash, and the like on the roller surface of the transfer device 26 and a temperature control to heat the roller is also initialized.

Next, the printing apparatus 1 initializes the host PC reception IF unit 5 (step S404). Specifically, a clearing process is executed for the information and the like stored in a buffer contained in the host PC reception IF unit 5 that temporarily stores the received information and the like and, also, a condition is created by which transmission of information is possible to the host PC connected to this host PC reception IF unit 5.

Next, the printing apparatus 1 executes initialization of the external equipment (step S405). Specifically, initialization is executed in a manner such that the external equipment such as the USB memory 9 and the fingerprint authentication device 10 connected to the USB host IF control unit 6 is in a condition that allows performance. Concerning the initialization process of this external equipment, a detailed explanation will be given later. The initialization process of the entire printing apparatus 1 is then finished.

Figure 5:
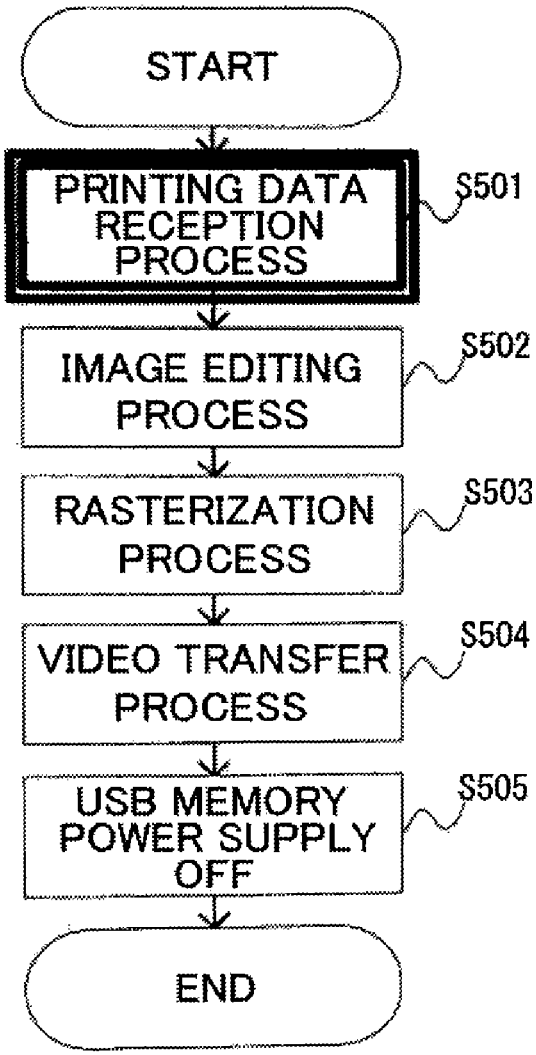
FIG. 5 is a flow chart showing the image generation process of the entire electronic apparatus of the first embodiment.

Concerning the image generation process that executes printing of the images by the printing control unit 3 at the aforementioned step S305 based on the printing data and the like, a detailed explanation is given based on FIG. 5. First, the printing control unit 3, using the host PC reception IF unit 6, executes the process to receive the printing data that includes data of the images and the like from the host PC 8 (step S501). Through this process, the printing data is stored in the storage unit 4 after being received. Concerning this process, a detailed explanation will be given later.

Next, the printing control unit 3 executes the process to edit the images based on the printing data (step S502). The printing control unit 3 analyzes the printing data stored in the storage unit 4, references the distinction information and the date and time information and the like of the printing information that was added to this printing data, and executes the process to sort the printing data in accordance with the order in which this data was sent to the print station unit 2. Assignment information assigning the font of the images included in each printing data on which the sorting process was executed is then referenced and the font data corresponding to each piece of assignment information is read in order from the USB memory 9 using the USB host IF control unit 6. The process is executed to combine this font data that was read with the printing data assigned by each piece of assignment information. The printing control unit 3 once again stores in the storage unit 4 each of these pieces of printing data upon which the combination process was executed.

Next, the printing control unit 3 executes the rasterization process for the printing data (step S502). The printing control unit 3 reads each printing data stored in the storage unit 4 and executes the process to convert each printing data from this rasterization process into image data that can be printed by the print station unit 2.

Next, the printing control unit 3 executes a video transfer process for the image data (step S504). The converted image data is sent to the print station unit 2 in the order determined by the distinction information and date and time information, conforming to the performance speed of the print station unit 2.

Next, the printing control unit 3 executes the process to turn off the USB memory 9 (step S505). A signal demanding stoppage of the power supply (VBUSONsignal=OFF) is sent to the IF power source control unit 7 and the power supply from the IF power source control unit 7 to the USB memory 9 is stopped. This process is performed at the time of the completion of the process for reading the font data from the USB memory 9 at the step S502.

Figure 7:
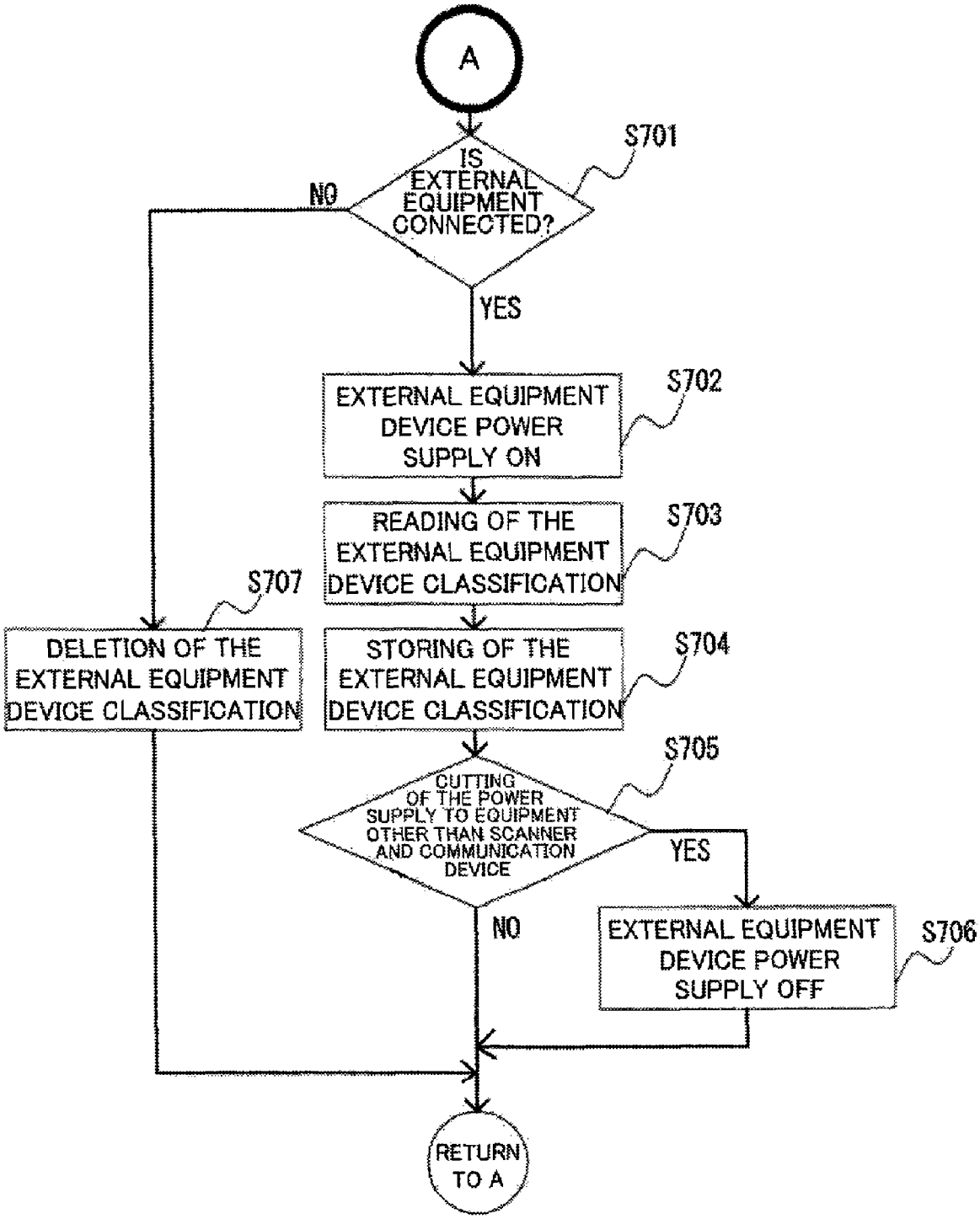
FIG. 7 is a flow chart showing the classification information retrieval process of the entire electronic apparatus of the first embodiment.

Concerning the process to retrieve the classification information from the external equipment in a case where a change has arisen in the connection condition of the aforementioned external equipment ("YES" of step S303), a detailed explanation is given based on FIG. 7. First, the printing control unit 3 executes the process for making a judgment as to whether the external equipment is newly connected to or removed from each interface equipped by the USB host IF control unit 6 (step S701). Using the IF power source control unit, and with the FET switch 95 in the IF power source unit 7 turned off, a small amount of current flows through the line VBUS into the external equipment and a judgment is made as to whether a signal FLAG was sent.

In a case where the signal FLAG is unsent and the external equipment is removed ("NO" of step S701), the process is executed to delete the classification information (step S707). The storage unit 4 is searched and the classification information showing the contents and the like that recorded the external equipment name, classification, electrical consumption, and maker corresponding to the interface unit removed from the external equipment is deleted. For example, in a case where the external equipment connected to the second interface unit that has a classification number of 2 is removed, the classification information corresponding to the second interface unit is deleted and, as shown in FIG. 12, the information "NONE" showing the removed status is displayed in the operation panel display unit 11.

In a case where the signal FLAG is sent and the external equipment is newly connected ("YES" of step S701), the process is executed to turn on this connected external equipment (VBUSONsignal=ON) (step S702). For example, in a case where a signal FLAG is sent from the second interface unit and the external equipment is newly connected, the VBUSON signal is activated using the IF power source control unit 7 to turn on the power source that supplies power from the second interface.

Next, the printing control unit 3 executes the process to retrieve the classification information from the external equipment (step S703). Communication for transmitting information with the newly attached external equipment is executed using the USB host IF unit 6 and the classification information and setting information of the address sent from the external equipment is received.

Next, the printing control unit 3 executes the process to store the classification information in the storage unit 4 (step S704). The classification information and setting information of the received address are each linked and stored in the storage unit 4. This classification is then displayed, as shown in FIG. 11, in the display portion corresponding to the interface unit newly connected to the external equipment.

Next, the printing control unit 3 makes a judgment as to whether the newly connected external equipment is not host external equipment such as a communication device (wireless LAN interface) and scanner, that is, equipment that the printing apparatus 1 cannot detect whether the equipment was activated (step S705). The classification contents included in the classification information stored in the storage unit 4 are referenced and a judgment is made as to whether the newly connected external equipment is a scanner and communication device that sends printing data, a separate host PC or the like, or host external equipment.

Next, in a case where the external equipment is host equipment ("NO" of step S705), the processes from the step S304 in the performance of the entire aforementioned printing apparatus 1 are performed.

Next, in case where the external equipment is not host equipment ("YES" of step S705), the process is executed to turn of this external equipment (step S706). Using the IF power source control unit 7, the power supply to this external equipment is stopped and the VBUSON signal is made inactive to turn off the power source.

Figure 8:
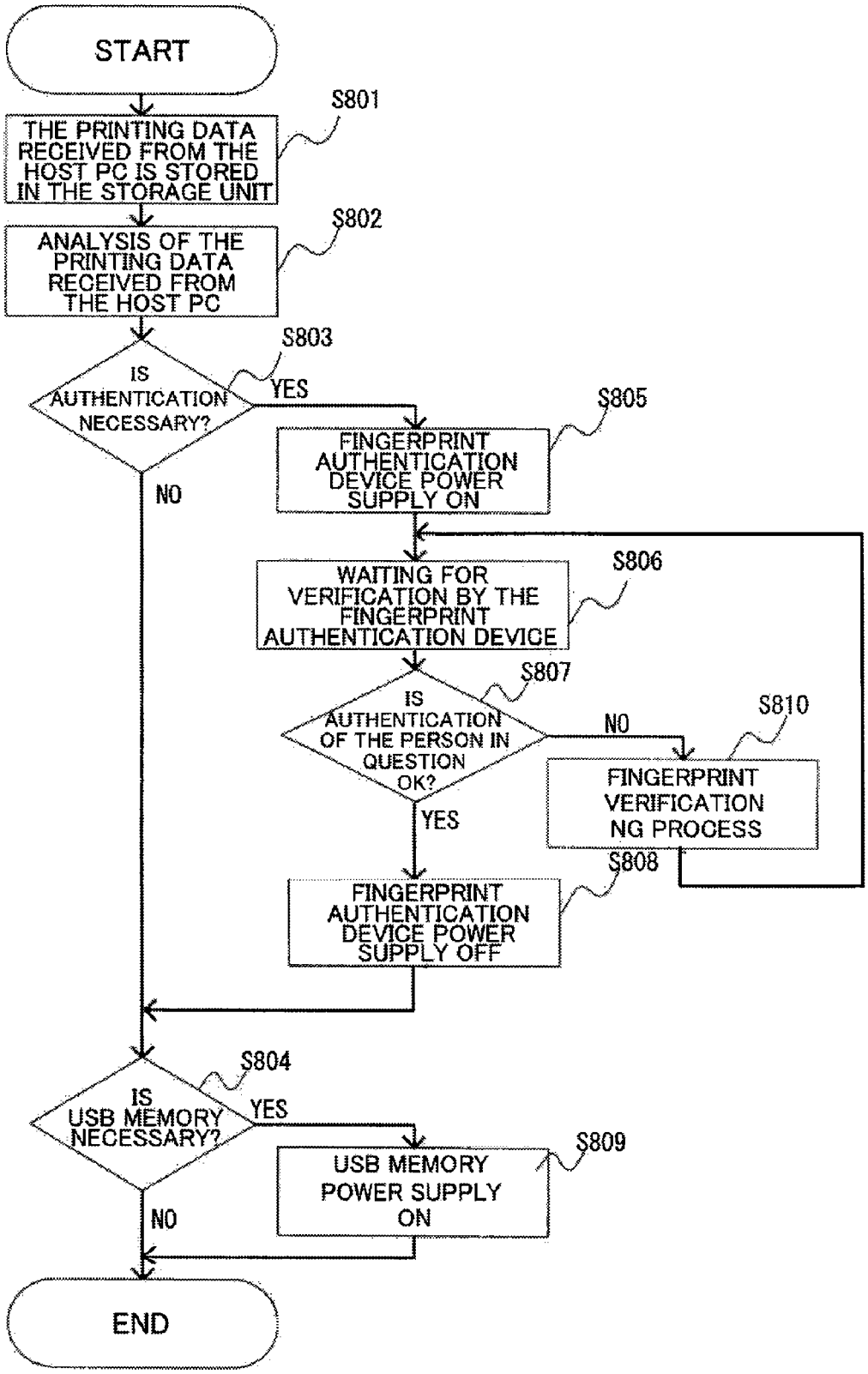
FIG. 8 is a flow chart showing the process at the time where printing data is received of the entire electronic apparatus of the first embodiment.

Concerning the process occurring when the printing apparatus 1 receives the printing data sent from the host PC 8, a detailed explanation is given based on FIG. 8. First, the printing control unit 3 stores the printing data in the storage unit 4 upon sending of the printing data from the host PC 8 via the host PC reception IF control unit 5 (step S801).

Figure 10:
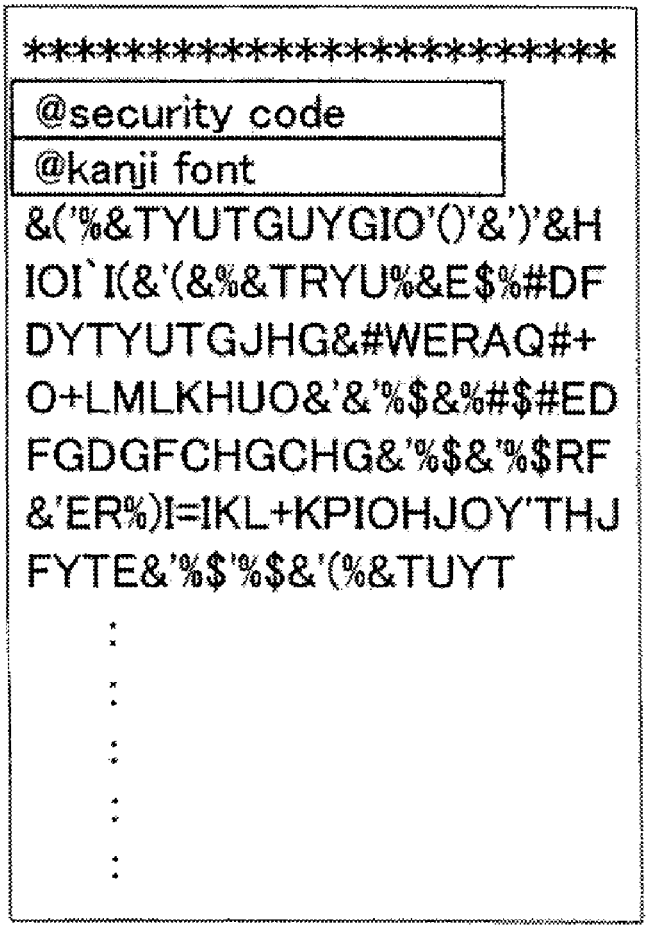
FIG. 10 is an explanatory diagram showing the printing data of the first embodiment.

Next, the printing control unit executes the process to analyze the printing data sent from the host PC 8 (step S802). The printing data stored in the storage unit 4 is referenced and the process is executed to retrieve the keyword showing processes that must be performed at a stage previous to the conversion of this printing data into pixel data. For example, as shown in FIG. 10, in a case where the word "@KANJI FONT" showing that kanji font is necessary in the middle of an image and the word "@SECURITY CODE" showing that the task of fingerprint authentication is necessary for printing are included in the printing data, these keywords are retrieved and stored in the RAM inside the storage unit 4.

Next, the printing control unit 3 executes the process to make a judgment as to whether the task of fingerprint verification is necessary for printing (step S803). The printing control unit 3 searches the RAM inside the storage unit 4 and, in a case where the keyword "@SECURITY CODE" is stored in the RAM, makes a judgment that fingerprint authentication is necessary. In a case where the keyword "@SECURITY CODE" is not stored in the RAM, a judgment is made that fingerprint authentication is not necessary.

Next, in a case where a judgment is made that fingerprint authentication is necessary ("YES" of step S803), the printing control unit 3 executes the process to turn on the power source of the fingerprint authentication unit 10 (step S805). Using the IF power source control unit 7, the VBUSON signal is activated to turn on the power source that supplies power to the interface unit connected to the fingerprint authentication unit 10.

Next, the printing control unit 3 waits until the verification results of the fingerprint authentication of the user are retrieved from the fingerprint authentication unit 10 (step S806). This waiting condition is maintained until command information is sent to the fingerprint authentication device 10 by the USB host IF control unit 6, the user presses his finger on the fingerprint authentication panel of the fingerprint authentication device 10 and the finger print data of the user's finger is extracted, the fingerprint authentication sensor executes the process to verify whether this fingerprint data is the same as the previously stored fingerprint data, and authentication is executed identifying the user based on the results of this verification process and the previously stored fingerprint data.

Next, the printing control unit 3 makes a judgment as to whether the user has been identified (step S807). A judgment is made as to whether the results of the verification process and the previously stored fingerprint data are the same and whether authentication was executed identifying the user.

Next, in a case where the user was not identified and authentication was not executed ("NO" of step S807), the results of fingerprint verification are NG (step S810), the process is executed for deletion or the like of the extracted fingerprint data, and the processes from the step S806 are repeated and performed again.

Next, in a case where the user was identified and authentication was executed ("YES" of step S807), the printing control unit 3 executes the process to turn off the fingerprint authentication device (step S808). Using the IF power source control unit 7, the VBUSON signal is set to inactivate to turn off the power source that supplies power to the interface unit connected to the fingerprint authentication unit 10.

Next, the printing control unit 3 executes the process to judge whether there is kanji font in the center of the images and whether the performance of the USB memory 9 is necessary (step S804). The printing control unit 3 searches the RAM inside the storage unit 4 and, in a case where the keyword "@KANJI FONT" is stored in the RAM, makes a judgment that kanji font is necessary. In a case where the keyword "@KANJI FONT" is not stored in the RAM, a judgment is made that kanji font is not necessary. In a case where a judgment is made that kanji font is not necessary ("NO" of step S804), the process is finished.

Next, in a case where a judgment is made that kanji font is necessary ("YES" of step S804), the printing control unit 3 executes the process to turn on the USB memory 9 (step S809). Using the IF power source control unit 7, the VBU- SON signal is activated to turn on the interface unit connected to the USB memory 9. The kanji font data stored in the USB memory 9 is then read via the USB host IF control unit 6 and stored in the storage unit 4. The process is then executed to turn off the USB memory 9 and the process is finished. On an occasion where the USB memory 9 is turned off, the VBUSON signal is set to inactive to turn off the USB memory 9 using the IF power source control unit 7.

In addition, the printing control unit 3 may retrieve the keyword retrieved at the step S802 and, without storing this keyword in the RAM inside the storage unit 4, execute this retrieval process (ON process) every time. Also, the font has priority over the fingerprint authentication and the fingerprint authentication may be turned on after creation of the data.

Figure 13:
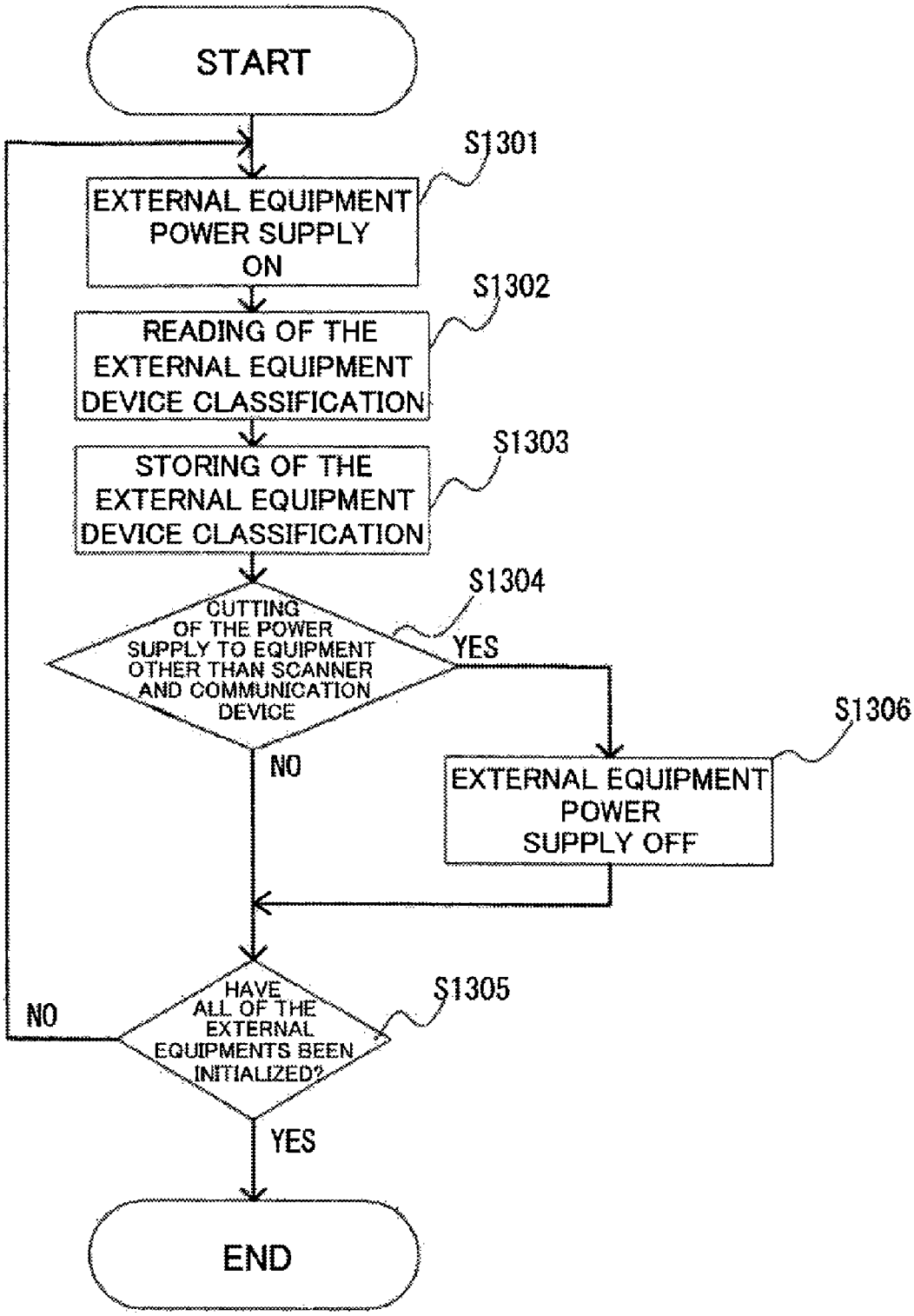
FIG. 13 is a flow chart showing the initialization process of the external equipment of the first embodiment.

Concerning the initialization process of the external equipment connected to each interface unit equipped by the USB host IF control unit 6 performed at a time where the printing apparatus 1 is turned on, a detailed explanation is given based on FIG. 13. First, where the initialization process of the external equipment is begun, the printing control unit 3 executes the process to turn on each of the external equipments, that is, the USB memory 9 and the fingerprint authentication device 10 (step S1301). At this time, the printing control unit 3 may also turn on the USB memory 9 and the fingerprint authentication device 10 one at a time. Using the IF power source control unit 7, the VBUSON signal is activated to turn on the interface unit connected to the USB memory 9 and fingerprint authentication unit 10.

Next, the printing control unit 3 executes the process to retrieve the classification information from the external equipment (step S1302). Using the USB host IF control unit 6, communication is executed for transmission with the newly connected external equipment and the classification information and setting information of the address sent from the external equipment is received.

Next, the printing control unit 3 executes the process to store the classification information in the storage unit 4 (step S1303). The classification information and setting information of the received address are each linked and stored in the storage unit 4. This classification is then displayed, as shown in FIG. 11, in the display portion corresponding to the interface unit newly connected to the external equipment.

Next, the printing control unit 3 makes a judgment as to whether the external equipment connected to the interface unit is not host external equipment such as a communication device and scanner, (step S1304). The classification contents included in the classification information stored in the storage unit 4 are referenced and a judgment is made as to whether the external equipment connected to the interface unit is a scanner and communication device that sends printing data, a separate host PC or the like, or host external equipment.

Next, in a case where the external equipment is host equipment ("NO" of step S1304), a judgment is made as to whether the process to turn on all of the external equipments was executed and initialization was performed (step S1305). In a case where the process turn on all of the external equipments is executed and initialization is performed ("YES" of step S1305), the process is finished. Also in a case where the process turn on all of the external equipments is not executed and initialization is not performed ("NO" of step S1305), the processes from the step S1301 are repeated and performed again.

Next, in a case where the external equipment is not host equipment ("YES" of step S1304), the process is executed to turn off this external equipment (step S1306). Using the IF power source control unit 7, the supply of power to this external equipment is stopped and the VBUSON signal is made inactive to turn off this external equipment.

In this way, the printing control unit 3 references the classification information and, in a case where the external equipment is not host external equipment such as USB memory 9 and a fingerprint authentication device 10 and it is not necessary to constantly keep the power on, the process is executed to set turn off this external equipment. The printing data is then analyzed and, in a case where a judgment is made that performances of the external equipment such as fingerprint authentication or kanji font are necessary, the process is executed to turn on the external equipment and, after completion of the performance of the external equipment, the process is executed to turn off this external equipment. For this reason, constant consumption of large amounts of power due to constantly powering all of the external equipment is prevented and, because the supply of power is always for 1 or fewer equipments even in a case where 2 or more external equipments are connected, it is possible to realize an efficient supply of power to the external equipment appropriate to the process performance condition of the printing apparatus 1.

In addition, for the performance of the external equipment, it is necessary to execute various settings of parameter information and the like that includes the address information of the printer in question. It is common for these settings to be executed for the external equipment in question by going through a communication procedure of multiple steps at the time of initialization of the external equipment. Accordingly, it is necessary to execute communication of these multiple steps every time the power source of the external equipment is changed from off to on. In the printing apparatus 1, at a time where the power supply to the external equipment is stopped, the parameter information that includes the address information of the external equipment may be read from this external equipment and, at a time where the power supply to the external equipment is resumed, the parameter information that was read may be set as the input setting for the external equipment. That is, in the printing apparatus 1, before the external equipment is turned off, the setting contents are read and retained and, after the printer in question is turned on, it is possible to complete the process demanding communication of multiple steps in a communication of one step through notifying the external equipment in question of the retained setting contents. Accordingly, in the printing apparatus 1, it is possible to quickly execute the initialization process of the external equipment and to advance the throughput of the entire printing.

Second Embodiment

Figure 15:
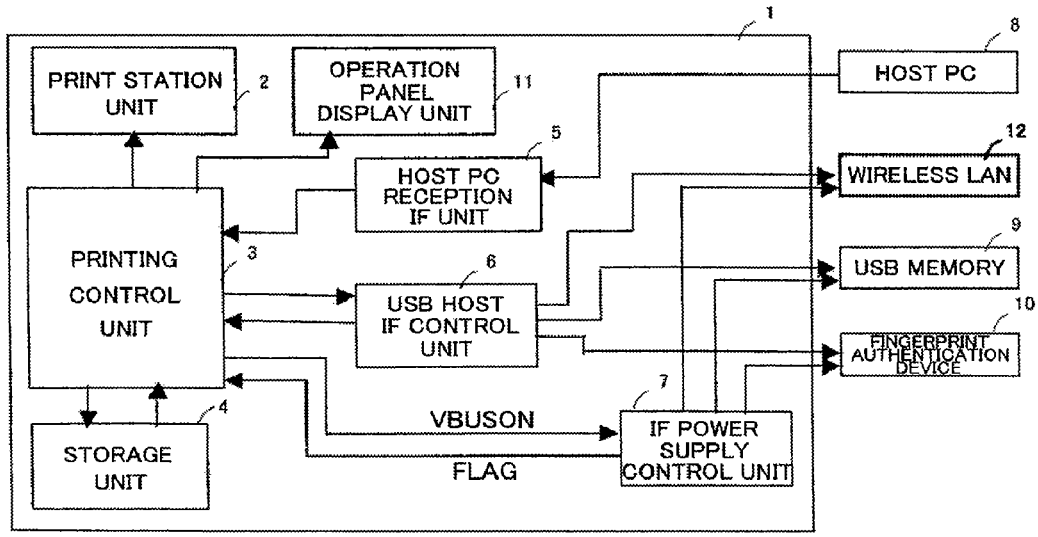
FIG. 15 is an explanatory diagram showing the construction of the electronic apparatus of the second embodiment.

The following is a detailed explanation using diagrams concerning the best mode for carrying out the second embodiment of the present invention. FIG. 15 is an explanatory diagram showing the construction of the printing apparatus 1 of the second embodiment. The printing apparatus 1 of the second embodiment has a wireless LAN device 12 that is capable of wirelessly executing transmission of information with equipment such as another host PC via a local network such as a LAN further connected as an external equipment to the interface unit equipped by the USB host IF control unit 6. Other construction is the same as the construction of the printing apparatus 1 of the first embodiment and therefore an explanation will be omitted.

Figure 14:
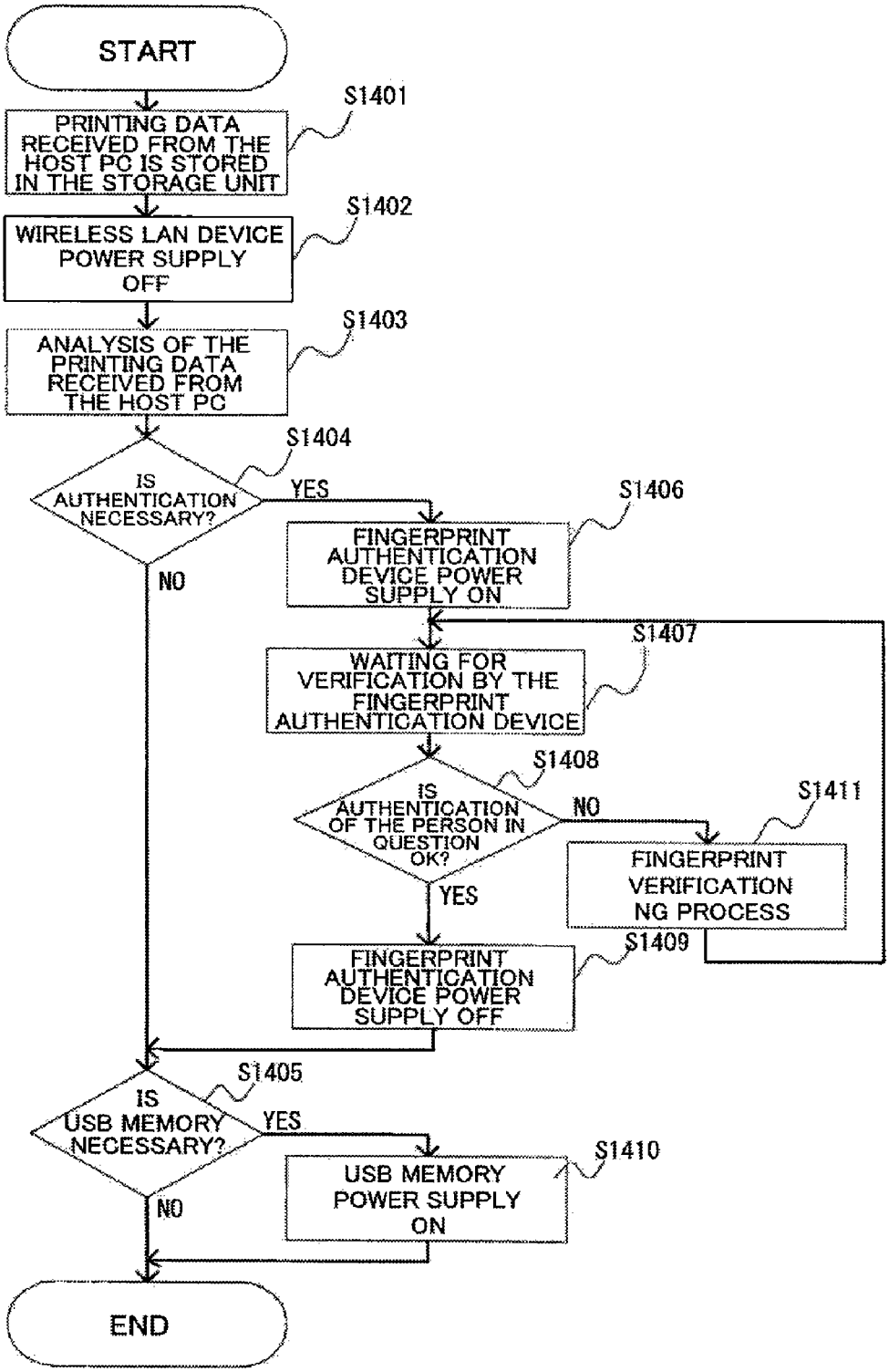
FIG. 14 is a flow chart showing the process at the time where printing data is received of the entire electronic apparatus of the second embodiment.

Concerning the performance of the printing apparatus 1 of the second embodiment, a detailed explanation is given using FIG. 14. The performance of the printing apparatus 1 of the second embodiment is roughly the same as the first embodiment but, because the process at the time where the printing apparatus 1 receives the printing data sent from the host PC 8 is different, a detailed explanation is given concerning this process. First, using the IF power source control unit 7, the printing control unit 3 activates the VBUSON signal to turn on the interface unit connected to the wireless LAN device 12. The printing data is then sent from another host PC different from the host PC 8 via the local network and, upon reception of the printing data by the wireless LAN device 12, is stored in the storage unit 4 (step S1401).

Next, in a case where the next printing data has not been received even though, for example, a prescribed time of 30 seconds has passed since the reception of the printing data, the printing control unit 3 executes the process to turn off the wireless LAN device 12 when a judgment is made that reception of the printing data is finished (step S1402). Using the IF power source control unit 7, the supply of power to the wireless LAN device 12 is stopped and the VBUSON signal is made inactive to turn of the wireless LAN device 12. Also at this time, the printing control unit 3 reads the parameter information that includes the IP address and the like from the wireless LAN device 12 and executes the process to store this information in the storage unit 4.

Next, the printing control unit 3 executes the process to analyze the printing data sent from the host PC (step S1403). The printing data stored in the storage unit 4 is referenced and the process is executed to retrieve the keyword showing processes that must be performed at a stage previous to the conversion of this printing data into pixel data. For example, as shown in FIG. 10, in a case where the word "@KANJI FONT" showing that kanji font is necessary in the middle of an image and the word "@SECURITY CODE" showing that the task of fingerprint authentication is necessary for printing are included in the printing data, these keywords are retrieved and stored in the RAM inside the storage unit 4.

Next, the printing control unit 3 executes the process to make a judgment as to whether the task of fingerprint verification is necessary for printing (step S1404). The printing control unit 3 searches the RAM inside the storage unit 4 and, in a case where the keyword "@SECURITY CODE" is stored in the RAM, makes a judgment that fingerprint authentication is necessary. In a case where the keyword "@SECURITY CODE" is not stored in the RAM, a judgment is made that that fingerprint authentication is not necessary.

Next, in a case where a judgment is made that fingerprint authentication is necessary ("YES" of step S1404), the printing control unit 3 executes the process to turn on the fingerprint authentication unit 10 (step S1406). Using the IF power source control unit 7, the VBUSON signal is activated to turn on the interface unit connected to the fingerprint authentication unit 10.

Next, the printing control unit 3 waits until the verification results of the fingerprint authentication of the user are retrieved from the fingerprint authentication unit 10 (step S1407). This waiting condition is maintained until command information is sent to the fingerprint authentication device 10 by the USB host IF control unit 6, the user presses his finger on the fingerprint authentication panel of the fingerprint authentication device 10 and the finger print data of the user's finger is extracted, the fingerprint authentication sensor executes the process to verify whether this fingerprint data is the same as the previously stored fingerprint data, and authentication is executed identifying the user based on the results of this verification process and the previously stored fingerprint data.

Next, the printing control unit 3 makes a judgment as to whether the user has been identified (step S1408). A judgment is made as to whether the results of the verification process and the previously stored fingerprint data are the same and whether authentication is executed identifying the user.

Next, in a case where the user is not identified and authentication is not executed ("NO" of step S1408), the results of fingerprint verification are NG (step S1411), the process is executed for deletion or the like of the extracted fingerprint data, and the processes from the step S1407 are repeated and performed again.

Next, in a case where the user is identified and authentication is executed ("YES" of step S1408), the printing control unit 3 executes the process to turn off the fingerprint authentication device to (step S1409). Using the IF power source control unit 7, the VBUSON signal is set to inactivate to set the power source that supplies power to the interface unit connected to the fingerprint authentication unit 10 to OFF.

Next, the printing control unit 3 executes the process to make a judgment as to whether there is kanji font in the center of the images and whether the performance of the USB memory 9 is necessary (step S1405). The printing control unit 3 searches the RAM inside the storage unit 4 and, in a case where the keyword "@KANJI FONT" is stored in the RAM, makes a judgment that kanji font is necessary. In a case where the keyword "@KANJI FONT" is not stored in the RAM, a judgment is made that kanji font is not necessary. In a case where a judgment is made that kanji font is not necessary ("NO" of step S1405), the process is finished.

Next, in a case where a judgment is made that kanji font is necessary ("YES" of step S1405), the printing control unit 3 executes the process to set the power source of the USB memory 9 to ON (step S1410). Using the IF power source control unit 7, the VBUSON signal is activated to turn on the interface unit connected to the USB memory 9. The process is then finished.

Figure 16:
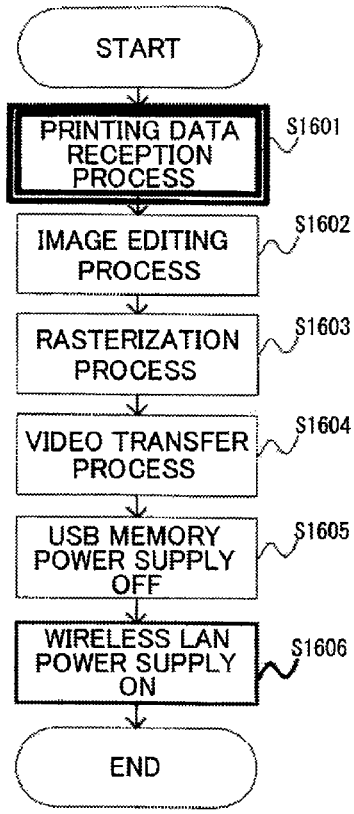
FIG. 16 is a flow chart showing the image generation process of the electronic apparatus of the second embodiment.

Concerning the image generation process that executes printing of the images by the printing control unit 3 at the step S305 of the first embodiment based on the printing data and the like, a detailed explanation is given based on FIG. 16. The wireless LAN device 12 is turned off at the aforementioned step S1402. The printing control unit 3, using the host PC reception IF unit 6, executes the process to receive the printing data that includes data of the images and the like from the host PC 8 (step S1601), so that the printing data is stored in the storage unit 4 after being received. Concerning this process, a detailed explanation will be given later.

Next, the printing control unit 3 executes the process to edit the images based on the printing data (step S1402). The printing control unit 3 analyzes the printing data stored in the storage unit 4, references the distinction information and the date and time information and the like of the printing information that was added to this printing data, and executes the process to sort the printing data in accordance with the order in which this data was sent to the print station unit 2. Assignment information assigning the font of the images included in each printing data on which the sorting process was executed is then referenced and the font data corresponding to each piece of assignment information is read in order from the USB memory 9 using the USB host IF control unit 6. The process is executed to combine this font data that was read with the printing data assigned by each piece of assignment information. The printing control unit 3 once again stores in the storage unit 4 each of these pieces of printing data upon which the combination process was executed.

Next, the printing control unit 3 executes the rasterization process for the printing data (step S1403). The printing control unit 3 reads each printing data stored in the storage unit 4 and executes the process to convert each printing data from this rasterization process into image data that can be printed by the print station unit 2.

Next, the printing control unit 3 executes the video transfer process for the image data (step S1404). The converted image data is sent to the print station unit 2 in the order determined by the distinction information and date and time information, conforming to the performance speed of the print station unit 2.

Next, the printing control unit 3 executes the process to turn off the USB memory 9 (step S1405). A signal demanding stoppage of the power supply is sent to the IF power source control unit 7 and the supply of power from the IF power source control unit 7 to the USB memory 9 is stopped. This process is performed at the time of the completion of the process for reading the font data from the USB memory 9 at the step S1402.

Next, the printing control unit 3 executes the process to turn on the wireless LAN device 12 (step S1606). Using the IF power source control unit 7, the VBUSON signal is activated to turn on the interface unit connected to the wireless LAN device 12 to ON. The wireless LAN device 12 is turned on, making a condition where printing data is constantly receivable. At a time where the wireless LAN device 12 is turned on at the aforementioned step S1402, the parameter data that includes the IP address and the like previously retrieved from the wireless LAN device 12 and stored in the storage unit 4 is read and the process to input and set this data in the wireless LAN device 12 is executed and finished.

In this way, the printing control unit 3 constantly powers the wireless LAN device 12 making a condition capable of transmitting data and, when the printing data is received, turns off the wireless LAN device 12. The printing control unit 3 then references the classification information and, in a case where then external equipment is not host equipment such as USB memory 9 and a fingerprint authentication device 10 and it is not necessary to constantly power the equipment, the process is executed turn off the external equipment. The printing data is then analyzed and, in a case where a judgment is made that performances of the external equipment such as fingerprint authentication and kanji font are necessary, the process is executed to turn on the external equipment and, after completion of the performance of the external equipment, the process is executed to turn off this external equipment. Then, after the image generation process is executed, the pixel data is sent to the print station unit 2, printing is completed, and the wireless LAN device 12 is again turned on, making a condition by which transmission of the printing data is possible. In addition, the process to turn on the wireless LAN device 12 may be performed immediately after the process to turn off the external equipment.

For this reason, constant consumption of large amounts of power due to the supply of power to constantly power all of the external equipment is prevented and, further, even where the wireless LAN device 12 is connected and there are 3 external equipments and the like, due to the wireless LAN device 12 being temporarily turned off after reception of the printing data, it is possible to realize an efficient supply of power appropriate to the performance condition of the external equipment because the supply of power is always of an amount for 1 external equipment or less.

Other Embodiments

As other embodiments, the process in which the printing apparatus 1 receives the printing data sent from the host PC 8 can be executed in the following manners. First, the printing control unit 3 stores the printing data in the storage unit 4 upon reception of the printing data from the host PC 8 or another host PC.

Next, the printing control unit 3 executes the process to analyze the printing data sent form the host PC 8, retrieves multiple types of words included in the printing data at a time of printing such as words showing that kanji font is necessary in the center of the image and words showing that the task of fingerprint authentication is necessary, and creates a list showing the external equipment and the number of performances of the external equipment tasks through the printing process job performed with each printing data as shown in FIG. 17.

Next, according to this list, the printing control unit 3 repeats and again performs the process to execute the performance executing the process to turn on the external equipment. In a case where a judgment is made at first that fingerprint authentication is necessary by job 1, the process is executed to turn on the fingerprint authentication unit 10 and, after the verification results of the fingerprint authentication of the user are acquired and authenticated, the process is executed to turn off the fingerprint authentication unit 10. Then, according to the list, the same process is repeated and again performed for the USB memory 9 that is beneath the fingerprint authentication unit 10 in the list. Through this type of performance it is possible to achieve the same results as the first embodiment.

In the aforementioned embodiments, an explanation is given concerning embodiments related to the printing apparatus 1 but this is not limiting and the same performance can be carried out by various other types of equipment if the equipment is externally connectable to the external equipment by a USB interface and the like.

Also, the construction of the present invention relating to the printing apparatus 1 of the aforementioned embodiment is usable for a PC (personal computer), notebook PC, digital camera, scanner, word processor, multi-function printer (MFP), fax machine, copying apparatus, MP3 player, car navigation system, cellular telephone, and PDA.

In the aforementioned embodiments, in a case where a performance of the external equipment such as fingerprint authentication or reading of kanji font is necessary, the process is executed to turn on each of the external equipments but the printing apparatus 1 may read the sequencing information, previously included in the printing data, that shows the sequence for the performance of each of the external equipments such as the fingerprint authentication device 10 and USB memory 9 and execution of fingerprint authentication or reading of the kanji font, execute the process, according to this sequencing information, to sequentially turn on the external equipments, execute performances of each of the external equipments, and, after this, repeat the process to turn off each of the external equipments.

Also, in the aforementioned embodiments, in a case where performances of the external equipment such as fingerprint authentication or reading of kanji font are necessary, the process is executed to turn on each of the external equipments but the printing apparatus 1 may measure the required time information of the processes of each external equipment through execution of test performance and the like, previously store this information in the storage unit 4 for each external equipment, execute the performance of each external equipment by executing the process to turn on the external equipment in a sequence from the external equipment with short or long required time shown by the required time information, and, after this, repeat the process to turn off the external equipment.

Usage is possible through the electronic apparatus having an interface section capable of supplying power and transmitting information to the external equipments connected externally.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An electronic apparatus comprising:

an equipment connection unit connectable with a plurality of external equipments;

a communication device for communicating with a host apparatus;

a process judgment unit for judging, based on information received by the communication device, a process performed therein;

an equipment selection unit for selecting said external equipment requiring a supply of power based on a judgment result of said process judgment unit; and a power supply unit for supplying power to said external equipment selected by said equipment selection unit, wherein said process judgment unit analyzes received information and makes a judgment of the process to perform and said equipment selection unit selects said external equipment necessary to perform the process, the received information being printing data sent from a host apparatus.

2. An electronic apparatus comprising:

an equipment connection unit connectable with a plurality of external equipments;

a communication device configured to communicate with the external equipment connected to the equipment connection unit;

a retrieval unit configured to retrieve equipment information by the communication device from the external equipment;

a judgment unit configured to determine, based on the equipment information retrieved by the retrieval unit, whether power supplied to the external equipment must be continuously maintained or temporarily supplied; and a power control unit configured to supply power to the external equipment when the judging unit determines that power is required to be constantly maintained for the external equipment, and to stop supplying power to the external equipment when the judging unit determines that power is not required to be constantly maintained.

3. The electronic apparatus according to claim 1, further comprising a classification information retrieval unit for retrieving classification information concerning classification of said equipment from said external equipment connected to said equipment connection unit, wherein said equipment selection unit selects said external equipment requiring the supply of power based on the classification information retrieved by said classification information retrieval unit and the judgment result of said process judgment unit.

4. The electronic apparatus according to claim 1, further comprising a connection detection unit for detecting whether said external equipment is connected to or removed from said equipment connection unit.

5. An electronic apparatus having an interface unit capable of supplying power and transmitting and receiving information with respect to an external equipment connected externally, comprising:

a connection detection unit for detecting that the external equipment is connected to or removed from said interface unit;

a classification information retrieval unit for retrieving classification information concerning classification of said external equipment from said external equipment connected to said interface unit;

a communication device for communicating with a host apparatus;

a process analysis unit for analyzing a process performed based on information received by the communication device; and a power supply unit for selecting said external equipment requiring a supply of power and supplying power to said external equipment based on the classification information retrieved by said classification information retrieval unit and analysis results of said process analysis unit.

6. The electronic apparatus according to claim 5, wherein said connection detection unit detects whether the external equipment is connected to or removed from said interface unit in a condition where power is not supplied to said external equipment.

7. The electronic apparatus according to claim 5, further comprising an information reading unit for reading parameter information including address information of said external equipment at a time where said power supply unit stops the supply of power to said external equipment and an information setting unit for inputting the parameter information read by said information reading unit into said external equipment.

8. The electronic apparatus according to claim 5, further comprising a performance judgment unit for making a judgment as to whether performance of said external equipment connected to said interface unit in the process performed by said electronic apparatus is necessary based on the classification information and analysis results of said process analysis unit.

9. The electronic apparatus according to claim 5, wherein said process analysis unit detects a keyword showing the performance executed by said external equipment and included in the process data based on the process performed by said electronic apparatus, said performance judgment unit makes a judgment as to whether performance of said external equipment connected to said interface unit is necessary based on the classification information and the keyword detected by said process analysis unit, and said power supply unit, in a case where said performance judgment unit makes a judgment that performance of said external equipment is necessary, supplies power to said external equipment and stops the supply of power after the performance is finished.

10. The electronic apparatus according to claim 5, wherein said process analysis unit analyzes the process performed by said electronic apparatus based on the printing data sent via a network.

11. The electronic apparatus according to claim 2, wherein the received data is a performance instruction command input from an operation panel.

12. The electronic apparatus according to claim 2, wherein the external equipment is an interface and the judgment unit determines that power is required at the interface, the power control unit being configured to stop the supply of power to the interface upon completion of receipt of data by the communication device, and to restart the supply of power to the interface upon completion of processing of the received data.

* * * * *